United States Patent [19]

Tippetts et al.

[11] Patent Number: 4,852,613

[45] Date of Patent: Aug. 1, 1989

[54] FLUIDIC PUMP CONTROL SYSTEMS

[75] Inventors: John R. Tippetts; Geoffrey H. Priestman, both of Sheffield, United Kingdom

[73] Assignee: United Kingdon Atomic Energy Authority, London, England

[21] Appl. No.: 217,673

[22] Filed: Jul. 11, 1988

[30] Foreign Application Priority Data

Jul. 15, 1987 [GB] United Kingdom ..... 8716669

[51] Int. Cl.[4] ..... F15C 1/13

[52] U.S. Cl. ..... 137/805; 137/810; 137/820; 137/821; 137/565

[58] Field of Search ..... 137/805, 819, 820, 810, 137/821, 565; 417/122, 123

[56] References Cited

U.S. PATENT DOCUMENTS

| | | | |
|---|---|---|---|
| 3,176,920 | 4/1965 | Severson | 137/805 |
| 3,463,178 | 8/1969 | Kirchmier | 137/805 |
| 3,581,754 | 6/1971 | Adams | 137/805 |
| 3,713,456 | 1/1973 | Barnard | 137/805 |
| 3,730,180 | 5/1973 | Davison | 137/819 |

FOREIGN PATENT DOCUMENTS

| | | |
|---|---|---|
| 1106251 | 4/1965 | United Kingdom . |
| 1212312 | 11/1970 | United Kingdom . |
| 1292977 | 10/1972 | United Kingdom . |

*Primary Examiner*—A. Michael Chambers

*Attorney, Agent, or Firm*—King and Schickli

[57] ABSTRACT

A control system for a single acting or double acting fluidic pump comprising a detector stage (1), a power amplifiction stage (2) and a primary element stage (3). The detector stage comprises bistable fluidic amplifiers for detecting pressure changes in a gas pressure line (10) to a displacement vessel of the pump. The power amplification stage comprises at least one unvented bistable fluidic amplifier to amplify and direct signals from the detector stage to the primary element. The primary element can be a jet pump (12) and vortex amplifier (13) to provide high pressures in the gas pressure line (10).

9 Claims, 7 Drawing Sheets

30
24
4 DIODE PUMP
25
26
27
PRIMARY ELEMENTS
V11
V12
22
23
21
POWER AMPLIFICATION
AIR IN
R7
R8
DETECTION CIRCUIT
ON
ON
V7
V8
A4
A6
A5
20
R3
R6
V1
V2
V3
V4
V5
V6
R2
R5
R1
R4
N5
N6
V9
V10
N1
N2
N4
N3
N4
AIR IN

FLUIDIC PUMP CONTROL SYSTEMS

The present invention concerns control systems for fluidic pumps. In particular the invention concerns a control system for detecting changes in pressure from a pre-set threshold value which can be above or below ambient pressure.

FEATURES AND ASPECTS OF THE INVENTION

According to the invention a control system for a fluidic pump comprises in combination a detector stage, power amplification stage and a primary element stage, the detector stage comprising bistable fluidic amplifiers for detecting pressure changes in a gas pressure line to a displacement vessel of the fluidic pump, the power amplification stage comprising means to amplify and direct signals from the detection stage to the primary element and the primary element comprising means to achieve high drive pressures in the gas pressure line.

The detector stage can comprise three vented bistable fluidic amplifiers. For use with a single acting pump, that is a pump having a single displacement vessel which is alternately pressurized and exhausted to provide an intermittent output from the pump, a first amplifier monitors pressure in the gas line to the displacement vessel, and a second amplifier having a R-C feedback loop sets the drive phase time. For use with a double acting pump, that is a pump having a pair of displacement vessels which are pressurized and exhausted in anti-phase to provide a substantially continuous output from the pump, two amplifiers communicating with the respective gas pressure lines to the displacement vessels set the phase times and a third amplifier oscillates under control of alternate signals from the two amplifiers.

Conveniently, the power amplification stage comprises at least one unvented bistable fluidic amplifier with the inlet to the or each amplifier being connected to a pressure supply line. The primary element can be a jet pump and a vortex amplifier. Preferably, the power amplification stages comprise first and second unvented bistable fluidic amplifiers with the control ports of the first amplifier being connected to the outlets from the detector stage and the outlets from the first amplifier being connected to the control ports of the second amplifier. The outlets from the second amplifier communicate one with the jet pump and the other with the control port of the vortex amplifier in the primary element.

DESCRIPTION OF THE DRAWINGS

The invention will be described further, by way of example, with reference to the accompanying drawings; in which.

DESCRIPTION OF THE PREFERRED EMBODIMENTS

Figure 1:
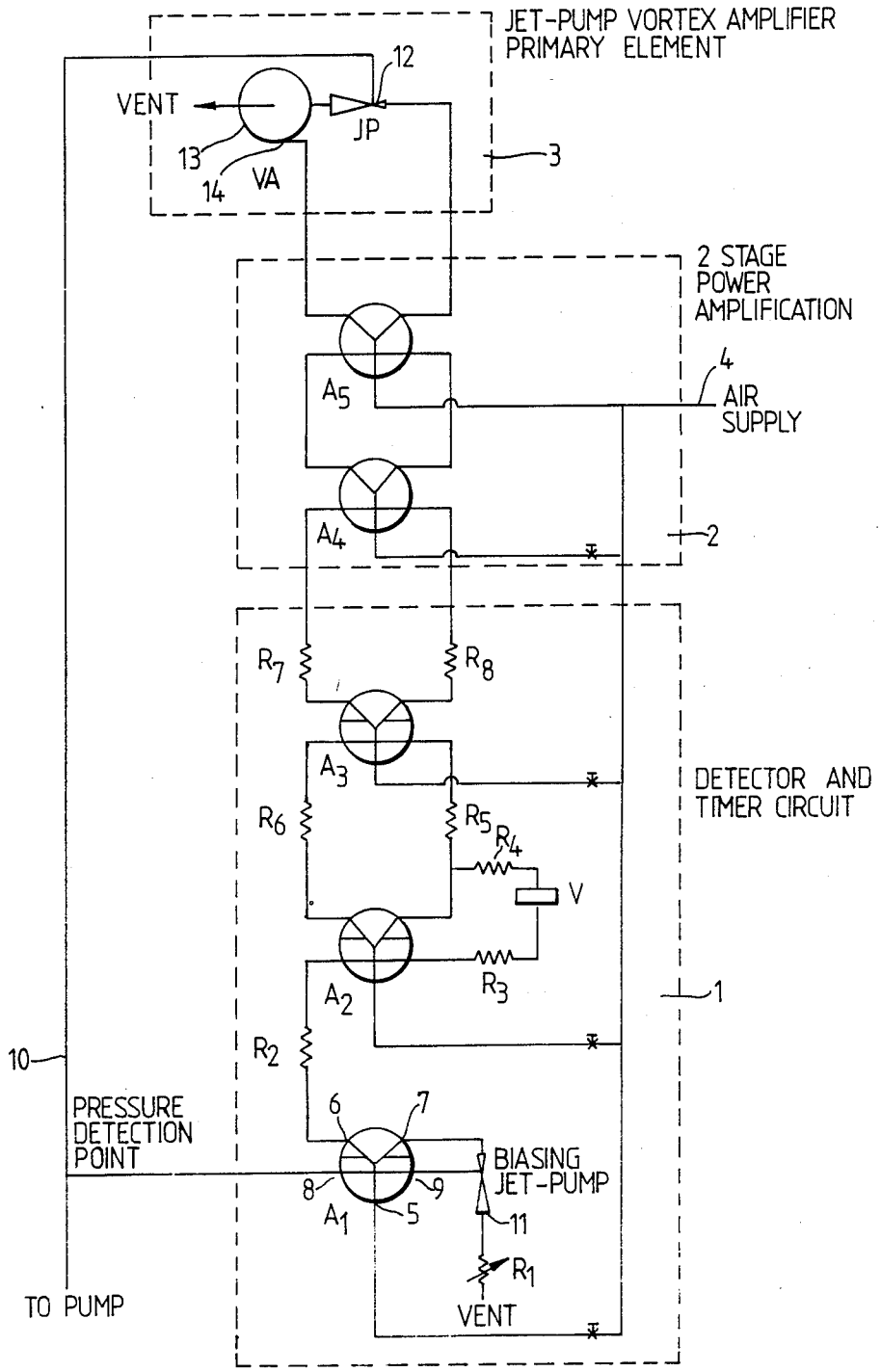
FIG. 1 is a schematic circuit diagram of an embodiment of a fluidic pressure activated controller for use with single acting pumps.

With reference to FIG. 1, a fluidic pressure activated controller comprises three distinct interconnected stages as indicated by the dotted outlines. A first stage constitutes a detector and timer circuit 1, second stage constitutes power amplification 2 and a third stage constitutes a primary element 3.

The detector and timer circuit 1 comprises three vented bistable amplifiers $A_1$, $A_2$ and $A_3$. Each amplifier functions as a flow diverter to direct an inlet supply to one of two outlets in response to a sufficient pulse or pressure difference across the control ports. Thus with reference to amplifier $A_1$, an inlet supply from an air supply line 4 is connected to inlet port 5 of the amplifier. The outlet ports are denoted by the reference numbers 6, 7 and the control ports are denoted by the reference numbers 8, 9. Control port 8 is connected to a line 10 loading to a displacement vessel of a single acting fluidic pump (not shown). An example of such a pump is disclosed in UK Patent Specification No. 1480484 with reference to FIG. 6. Control port 9 is connected to a biasing jet pump 11 which functions to ensure that the amplifier $A_1$ is switched to outlet 7 unless the pressure detected at the opposite control port 8, which is the pressure detected in the line 10 to the pump, falls below the bias pressure created by the jet pump 11. The bias pressure can be varied as desired by means of an adjustable flow resistor $R_1$ located in a vent line from the jet pump 11. Thus, when the pressure in line 10 exceeds the bias pressure, which occurs during a drive phase of the pump, the air flow through amplifier $A_1$ is from the inlet port 5 to the outlet port 7 and then through the jet pump 11 to vent.

If the pressure in the line 10 falls sufficiently below the bias pressure the amplifier $A_1$ immediately switches to direct the inlet supply to the outlet port 6 which is connected to one of the control ports of the second amplifier $A_2$ in the detector and timer circuit. Amplifier $A_2$ determines the drive phase time by means of R-C feedback loop $R_4$-V-$R_3$ and $R_5$. $R_3$ is adjustable whereby to selectively vary the drive phase time. The third amplifier $A_3$ and the resistors $R_6$, $R_7$ and $R_8$ stabilise the detector and timer circuit by isolating amplifier $A_2$ and $A_1$ from the power stages 2. The power stage 2 can comprise one or more unvented bistable amplifiers. In FIG. 1, stage 2 comprises two unvented bistable amplifiers $A_4$ and $A_5$ which function to amplify the control signals from the detector and timer circuit 1 to the pressures required to drive the primary element 3. The power output of stage 2 is a function of the number of amplifiers in the stage.

The primary element 3 comprises a jet pump 12 and a vortex amplifier 13. The outlet ports from the amplifier $A_5$ are connected one to the jet of the jet pump 12 and the other to the control port 14 of the vortex amplifier. The jet pump 12 is activated by flow from the line 4 and the amplifier $A_5$ arriving at the jet to entrain air from the line 10 leading to the pump and thereby effect a depression in the line 10. The flow from the jet pump is vented to atmosphere through the vortex amplifier 13 which is in its low resistance state.

When the flow through the amplifier $A_5$ is switched to arrive at the control port of the vortex amplifier this results in pressure feedback to the power amplifiers and the production of high drive pressures.

Figure 2:
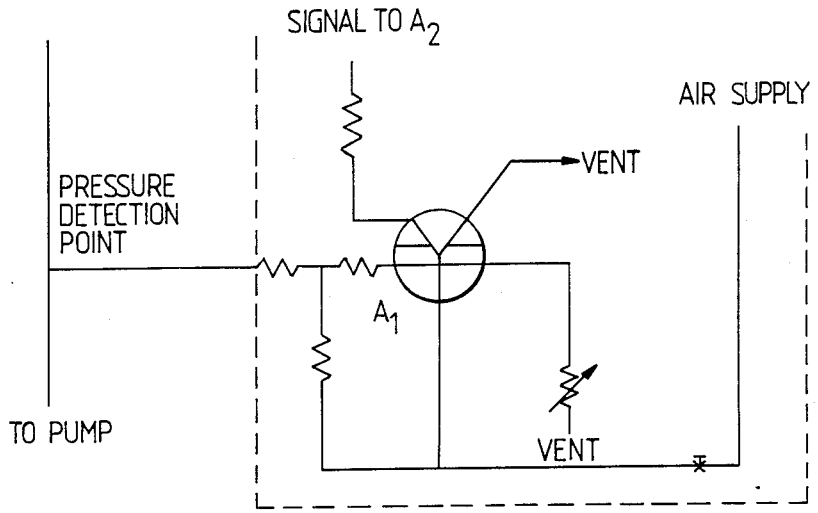
FIG. 2 shows a first modification of the controller.

FIG. 2 shows an alternative arrangement for switching the amplifier $A_1$ and which avoids the use of a jet-pump and has the advantage that it can be arranged to supply a continuous flow of air into the pump line 10 at the detection point. The values of the resistances determine the threshold pressure which can be greater or less than ambient. The output at the right hand side of $A_1$ in FIG. 2 leads directly to vent although it can be combined with the control port to lead to vent.

Figure 3:
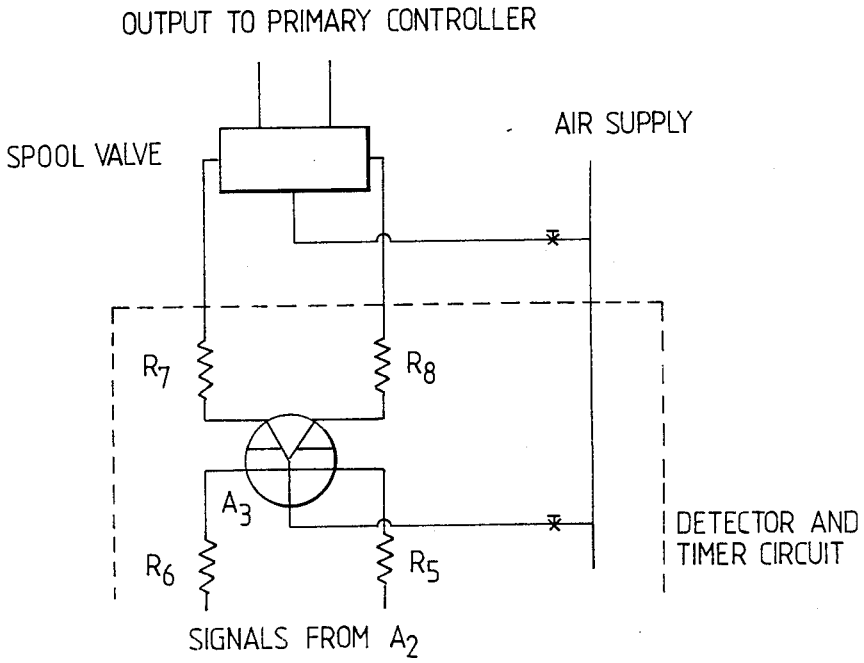
FIG. 3 shows a further modification.

In the modification according to FIG. 3, the output from the detector and timer circuit stage is used to activate a moving-part power amplifiction stage, for example, a spool valve system. With such an arrangement it is not necessary to have feedback from the primary element it possible to employ jet-pump pairs.

Figure 4:
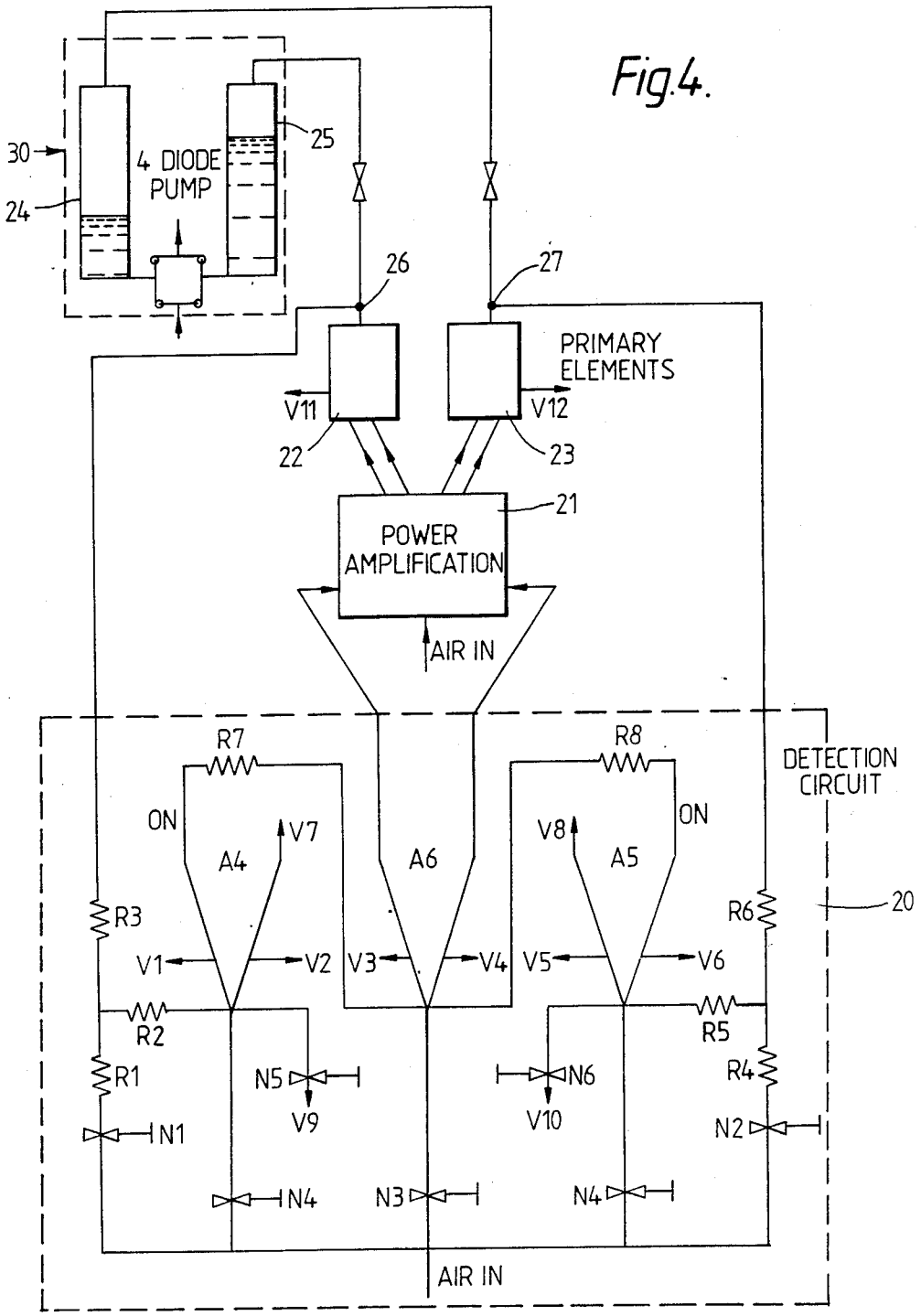
FIG. 4 is a schematic circuit arrangement of an embodiment of a pressure activated fluidic controller for use with double acting pumps.
Figure 8:
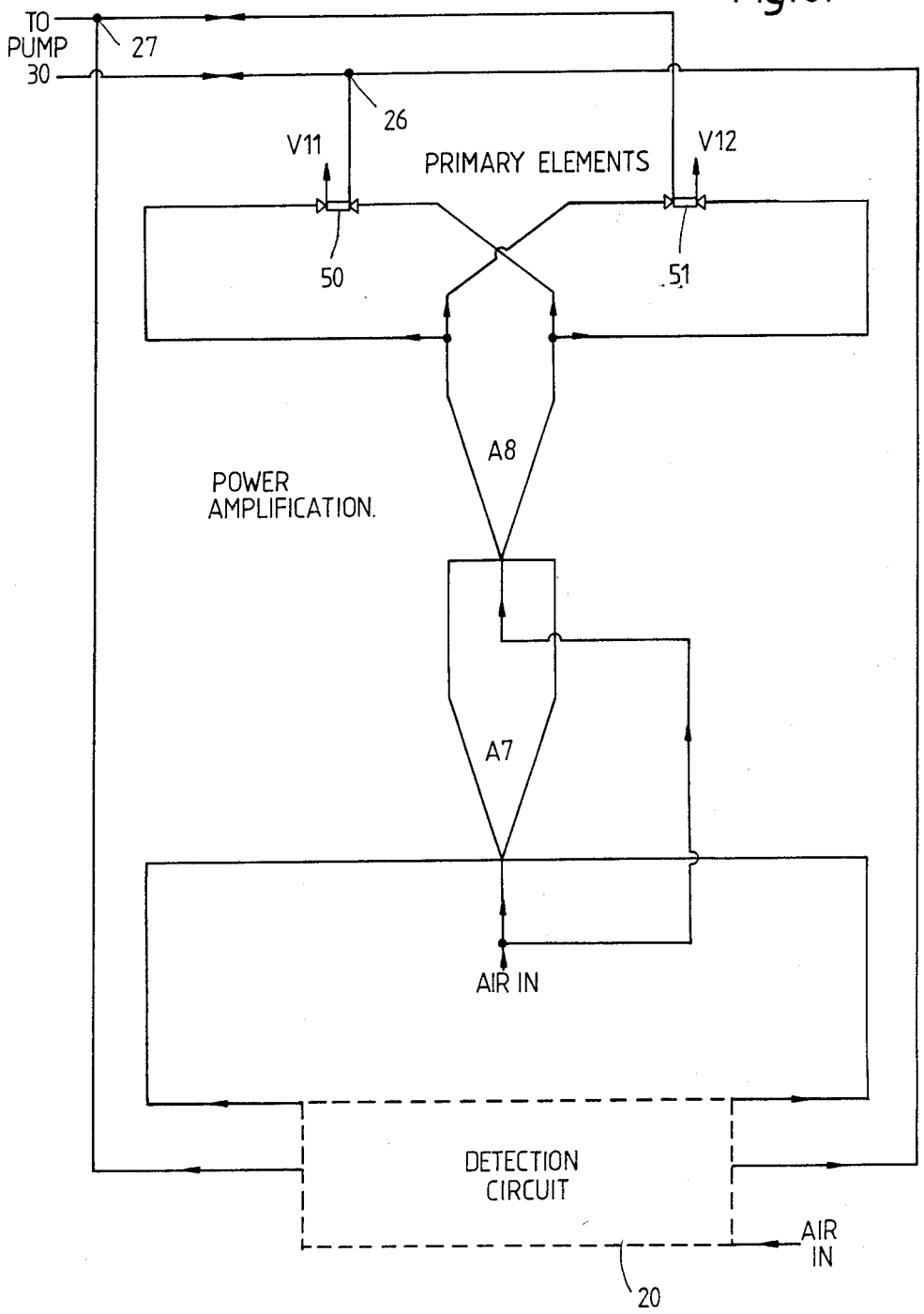

FIG. 4 is a schematic circuit arrangement of a controller for use with double acting pumps, for example pumps of the type as disclosed with reference to FIG. 8 of UK Patent Specification No. 1480484 and which are capable of providing a substantially continuous outflow. Again, the controller can be regarded as three stages. A first stage constitutes a detection circuit 20, a second stage provides power amplification 21 and a third stage constitutes the primary elements 22, 23. The primary elements supply reciprocating air flow to the two displacement vessels of a double acting pump, with the return air going to vent. The primary elements are fed by modulated high pressure air from the power amplification stage. The appropriate modulation of this flow is goverened by switching signals from the detection circuit. For certain types of double-acting pumps it is possible to operate the system stably by using a free running oscillator to govern the power modulation, the system being stabilised by hydrostatic forces within the pump displacement vessels. For other types of pump, such as a 4-diode pump 30 depicted in FIG. 4, suction has to be applied to refill displacement vessels 24, 25 and the vessels hydrostatic forces cannot be relied upon to stabilise the pump system. In such cases a degree of information about the liquid position in the vessels 24, 25 can be fed back to the controller utilising the detection circuit.

The detection circuit 20 comprises three vented bistable amplifiers, A4, A5 and A6 together with a number of needle valves N1 and N6 and fixed flow resistances R1 to R8 as shown in FIG. 4. The legends V1 to V12 denote vents. The amplifiers A4 and A5 monitor the pressure at the detection points 26, 27 in the air pipes from the primary elements 22, 23 to the displacement vessels 25, 24 respectively. These operate in the same way as the pressure detecting first stage amplifier A1 of the controller with selective biasing shown in FIG. 2. The main difference between controllers for single and double acting pumps is that in the former the second amplifier A2 has an R-C feedback loop which sets the second phase time of the pump, whereas for double acting pumps both phase times are set by pressure detecting amplifiers A4 and A5. The third amplifier A6, oscillates under the control of alternate signals from A4 and A5. For a 4-diode pump, where suction refill is needed, the resistive biasing circuits R1 R2 R3 N1 and R4 R5 R6 N2 and the two valves N5 and N6, are set such that there is a continuous flow of air into the detection points 26, 27 and such that amplifiers A4 and A5 will switch to the "on " side when the pressure at the respective detection point falls below the desired negative switch value. The switch pressures can be set such that switching occurs either when the liquid level in the associated displacement vessel approaches the top of the vessel, or when it rises up the air pipe. The pump therefore operates with the phase switching governed in effect by top level detection in each vessel, with no feedback relating to the bottom levels.

In operation, assume that primary element 22 is driving and 23 is sucking. The liquid level in displacement vessel 24 will rise and that in vessel 25 will fall. As this occurs the pressure in vessel 24 will fall, initially due to blowdown, then primarily due to the increasing hydrostatic pressure of the liquid column in the vessel effecting the operating point on the primary element suction characteristic. When the suction pressure falls below the preset switch pressure then A5 will switch to "on ". This sends a switch signal to A6 which switches to the V3 side. This in turn sends a signal to the power amplifier 21 such that primary element 23 switches to drive and primary element 22 to suction. This causes the pressure from primary element 23 to rise quickly past the switch value and A5 switches back to the V8 side that is to vent. This state continues until the pressure at the detection point 26 goes below the switch value of A4, at which point the primary element states are again switched. Thus the duration of the phase is determined by the time required to refill that volumne of displacement vessel driven out during the previous phase. The dynamics of the system are such that for a given pump load, increasing the drive pressure or decreasing the suction pressure increases the phase time and stroke length, and vice-versa. The pump therefore operates over a range of pressures for which the stroke is of a reasonable length and confined within the vessels. Normally, unless cavitation limits are reached, the greater the degree of suction then the higher the drive pressure that can be used for a given load and the higher the pump rate. The primary elements must therefore be designed such that a significant degree of suction can be generated.

Figure 5:
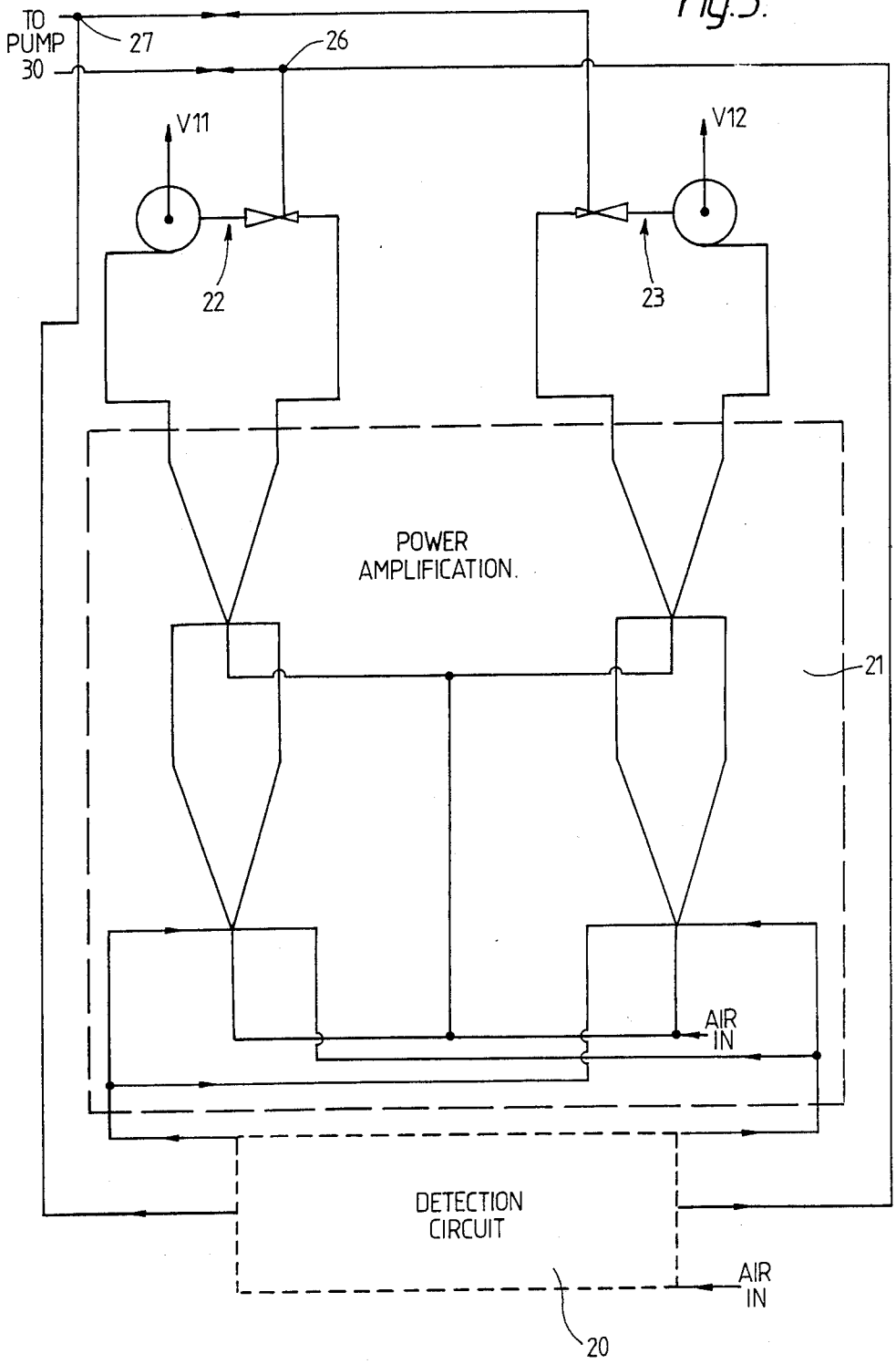
FIG. 5 is a diagram corresponding to FIG. 4 showing stages in the circuit.

FIG. 5 shows an embodiment of an all-fluidic circuit for the power amplification and primary element stages in FIG. 4. Each displacement vessel of the pump 30 is powered by two unvented Bistable Amplifiers driving a Jet Pump-Vortex Amplifier primary element as used in the system shown in FIG. 1. Each vessel is synchronously switched by common signals from the detection circuit 20.

Figure 6:
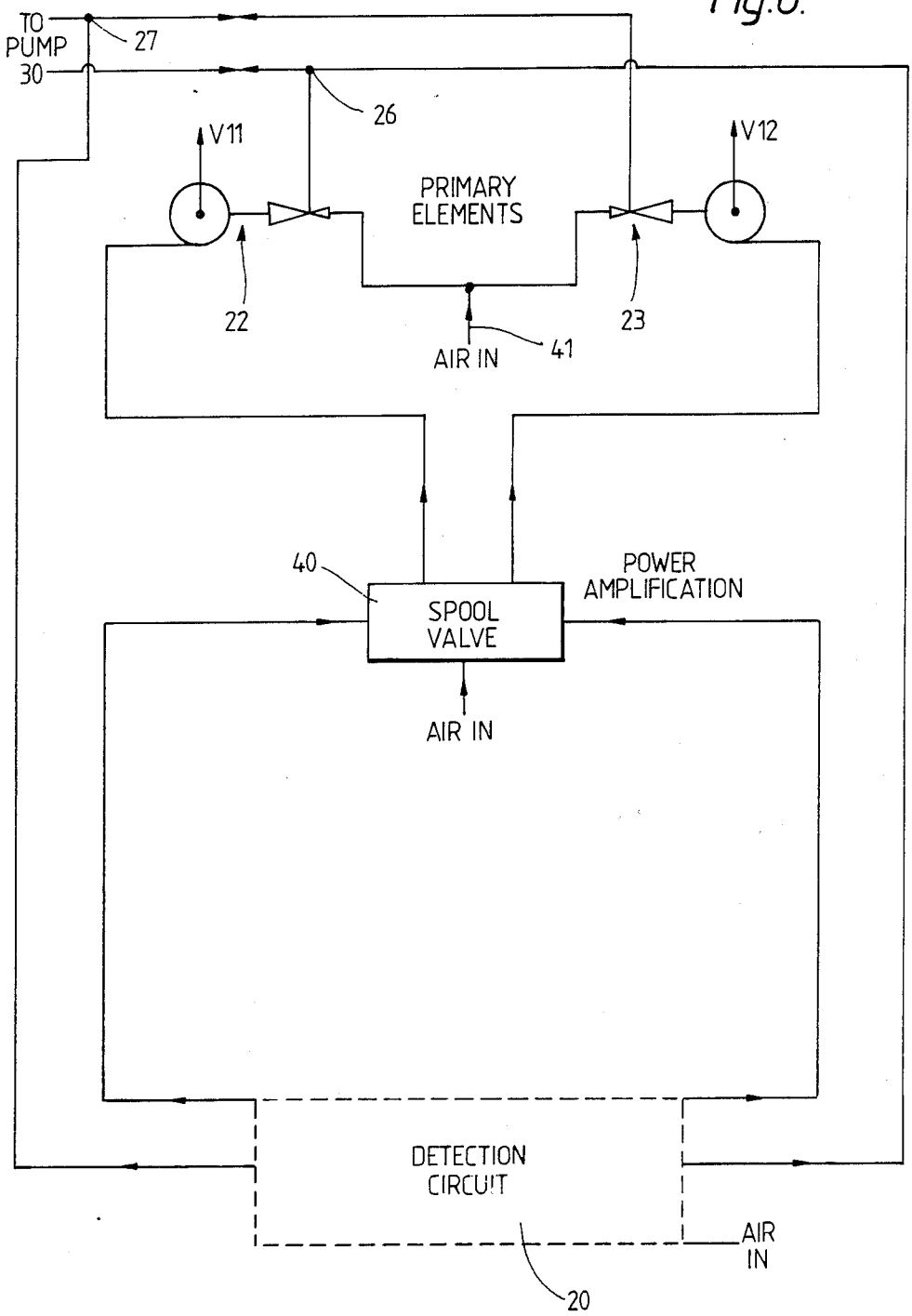
FIGS. 6 to 8 respectively show further diagrammatic embodiments of the controller.

FIG. 6 uses a moving part spool valve 40 for the power amplification. The primary elements are again jet pump-vortex amplifier assemblies. The spool valve, which controls only the vortex amplifier drive air, is switched by pneumatic signals from the detection circuit 20. The air supply to both the jet pumps is continuously fed from a common supply 41.

Figure 7:
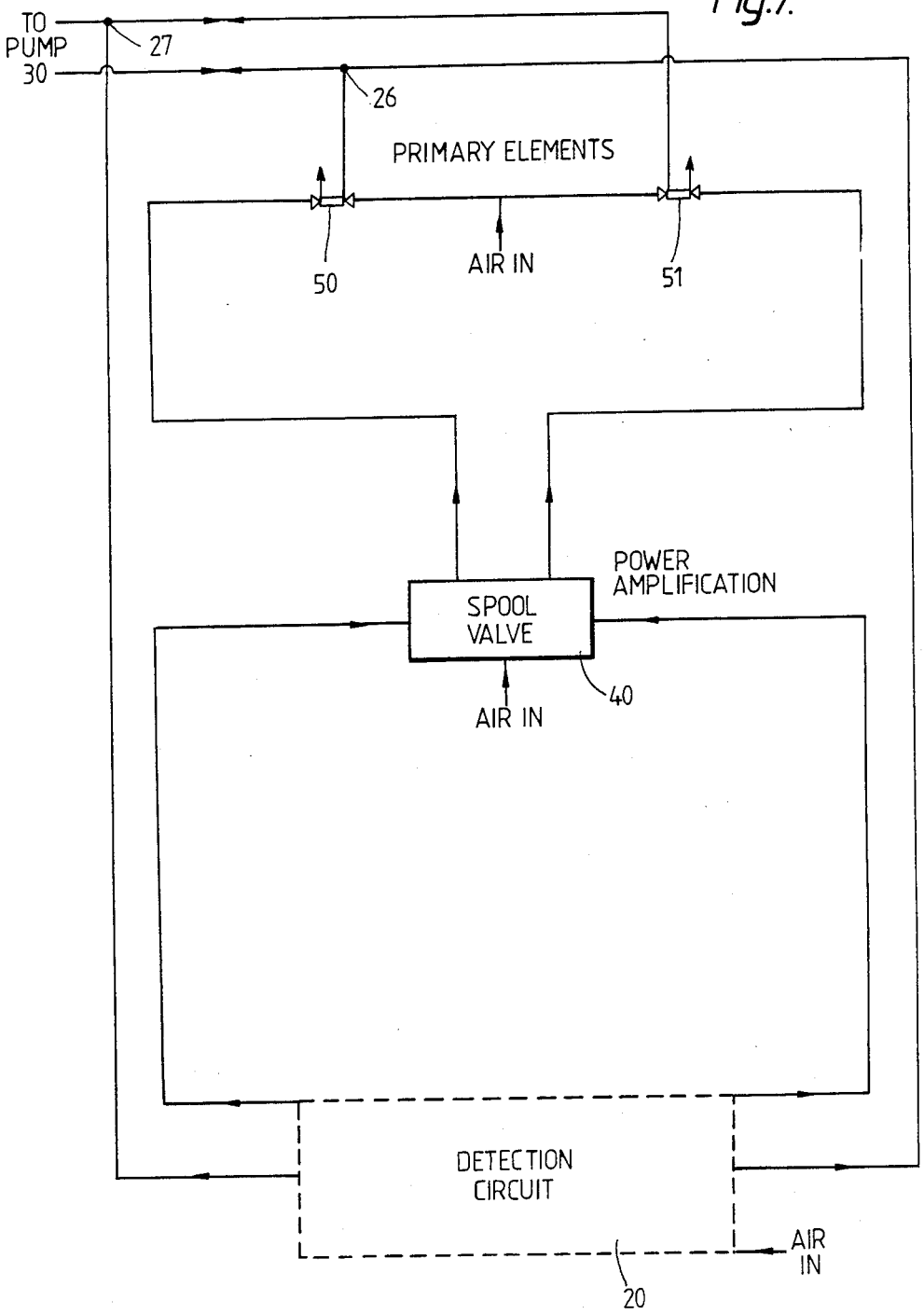

FIG. 7 shows another arrangement using a spool valve 40 for power amplification. This differs from the system shown in FIG. 6 in that it uses opposed jet pressure transformers (OJPTs) 50 and 51 for the primary elements instead of jet pumps and vortex amplifiers. An OJPT is also suitable for use with the system in FIG. 1 in place of the jet pump and vortex amplifier. Briefly, an OJPT comprises a pair of opposed jet nozzles opposing each other across an interspace constituting a mixer region. A vent communicates with the mixer region adjacent one of the nozzles and a radial dirruser or pipe communicates with the mixer region adjacent the other nozzle. Examples of OJPT's are disclosed in UK Patent Specification No. 2016739.

In the systems shown in FIGS. 6 and 7 the spool valve could be replaced by one or more stages of unvented bi-stable amplifiers.

FIG. 8 shows another embodiment of a fluidic control system. This uses a pair of bistable amplifiers A7, A8 for power amplification which feed two OJPT primary elements 50 and 51.

In FIG. 5 to 8 inclusive the detection circuit 20 is as described with reference to FIG. 4.

We claim:

1. A fluidic control system for a fluidic pump having a displacement vessel, the system comprising in combination a detection stage, a power amplification stage connected to receive signals from the detection stage, and a primary element stage connected to receive further signals from the power amplification stage, the detection stage comprising bistable fluidic amplifiers for detecting pressure changes in a gas pressure line to the displacement vessel of the fluidic pump and providing said signals in response to said changes, the power amplification stage comprising means to amplify the signals from the detection stage and direct the further signals to the primary element stage and the primary element having an output connected to the gas pressure line, the primary element stage comprising means responsive to the further signals from the power amplification stage and operative to achieve high drive pressure in the gas pressure line.

2. A control system according to claim 1 in which the detection stage comprises a plurality of vented bistable fluidic amplifiers.

3. A control system according to claim 2 including a first vented bistable fluidic amplifier for monitoring pressure in the gas pressure line to the displacement vessel and a second vented bistable fluidic amplifier having an R-C feedback loop to set a drive phase time.

4. A control system according to claim 2 for use with a double acting fluidic pump having a pair of displacement vessels in which two vented bistable fluidic amplifiers communicate with the respective gas pressure lines to the displacement vessels to set the phase times and a third vented bistable fluidic amplifier oscillates under control of alternate signals from the two vented bistable fluidic amplifiers.

5. A control system according to claim 1 in which the power amplification stage comprises at least one unvented bistable fluidic amplifier with the inlet to the or each unvented bistable fluidic amplifier being connected to a pressure supply line.

6. A control system according to claim 5 in which the power amplification stage comprises first and second unvented bistable fluidic amplifiers, the control ports or the first unvented bistable fluidic amplifier being connected to outlets from the detection stage and the outlets from the first unvented bistable fluidic amplifier being connected to the control ports of the second unvented bistable fluidic amplifier.

7. A control system according to claim 6 in which the outlets from the second unvented bistable fluidic amplifier communicate with the primary element stage.

8. A control system according to claim 1 in which the primary element stage comprises a jet pump and a vortex amplifer.

9. A control system according to claim 1 in which the primary element stage comprises opposed jet pressure transformers.

* * * * *